United States Patent [19]

Palau

[11] 4,222,415

[45] Sep. 16, 1980

[54] MECHANICAL DEVICE INTERPOSED BETWEEN A DOBBY AND A WEAVING LOOM

[75] Inventor: Joseph Palau, Duingt, France

[73] Assignee: Etablissements Staubli, Faverges, France

[21] Appl. No.: 14,178

[22] Filed: Feb. 22, 1979

[30] Foreign Application Priority Data

Apr. 18, 1978 [FR] France ..... 78 12858

[51] Int. Cl.[2] ..... D03C 13/00

[52] U.S. Cl. ..... 139/83

[58] Field of Search ..... 139/82, 83, 84, 87

[56] References Cited

U.S. PATENT DOCUMENTS 88,503 3/1869 Oldfield ..... 139/83

385,691 7/1888 Wyman ..... 139/83

431,263 7/1890 Hutchins ..... 139/83

*Primary Examiner*—Henry Jaudon

*Attorney, Agent, or Firm*—Dowell & Dowell

[57] ABSTRACT

A mechanical with cables interposed between a dobby or other shedding mechanism and the heddle frames of the corresponding weaving loom, of the type comprising, for each frame, two pulling cables associated with two swinging pulling levers or sectors connected by rods to the frame in question, wherein the axis of articulation of the rods on each lever is located substantially inside the profile of said latter, while the corresponding cable is guided obliquely in the direction of the dobby or other shedding mechanism, directly for one of the cables and with the interposition of a single central guide pulley for the other.

1 Claim, 6 Drawing Figures

Fig. 1
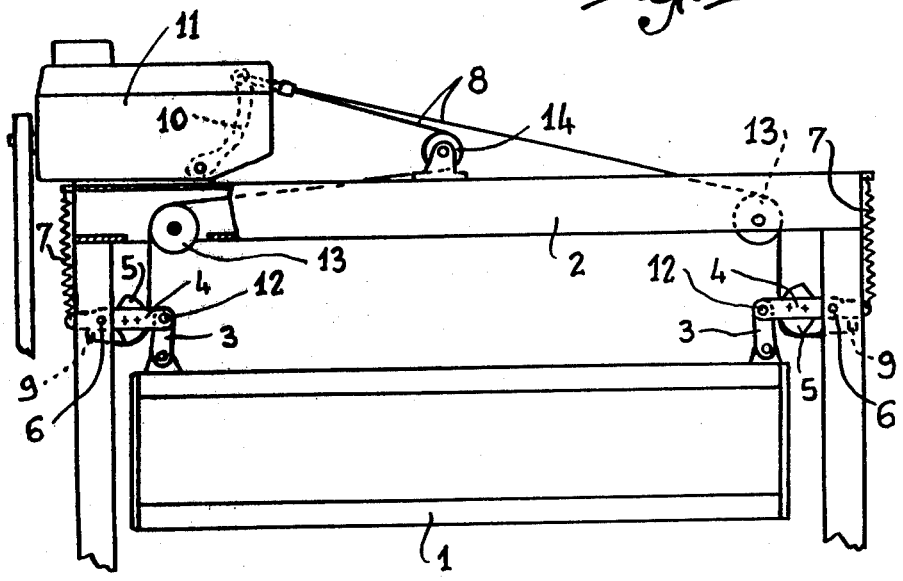
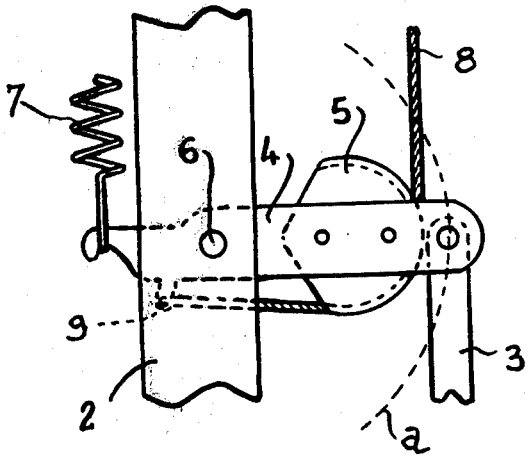
Fig. 2
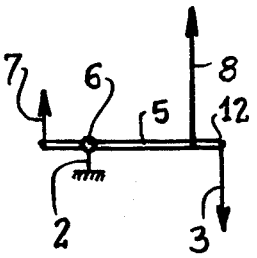
Fig. 3

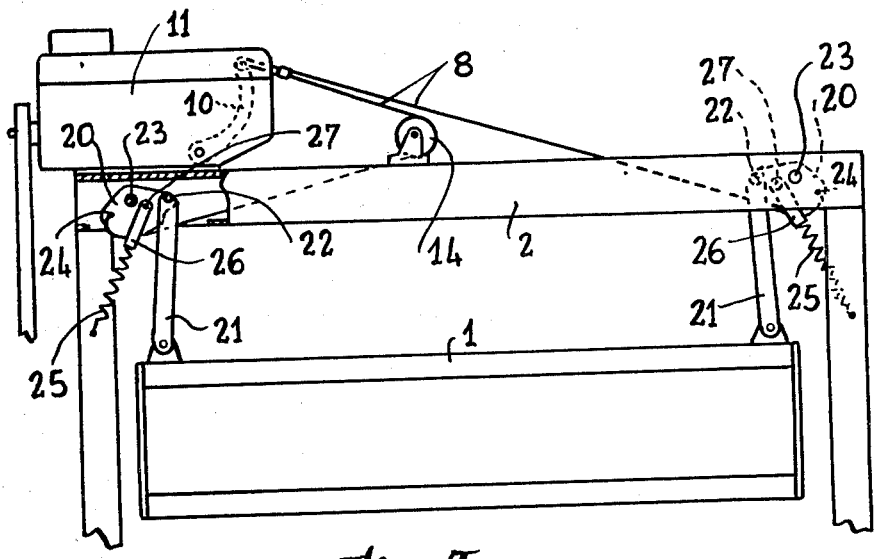
Fig. 4
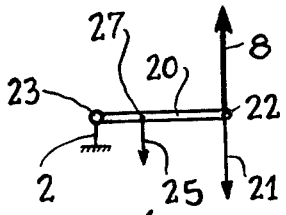
Fig. 6
Fig. 5
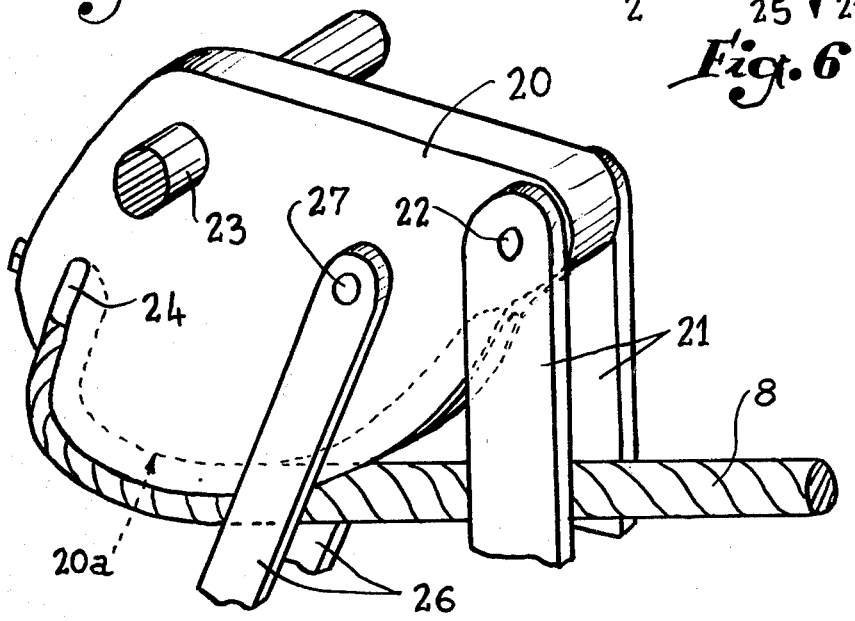

MECHANICAL DEVICE INTERPOSED BETWEEN A DOBBY AND A WEAVING LOOM

The present invention relates to dobbies and other mechanisms for the formation of the shed on weaving looms, and it relates more particularly to mechanical devices with cables interposed between said mechanisms and the corresponding heddle frames.

It is known that the vertical manoeuvring of the heddle frames involves a considerable effort further to the weight of these frames and the tension of the warp yarns which pass axially through the eyes thereof. In reverse, the force exerted by the weaving mechanisms is relatively limited, particularly when the dobbies are controlled by perforated paper in which the origin of the actuation is given by the pressure of application of needles against a strip of paper; it is true that this original control is amplified by a series of members acting in the manner of relays, but it is readily appreciated that the multiplication of these amplifiers renders the assembly heavier and constitutes a considerable practical hindrance when it is desired to have a dobby capable of functioning at very high speed.

The purpose of the improvements forming the subject matter of the present invention is more particularly to solve the above-mentioned problem by reducing the effort applied to the oscillating arms pulling the mechanisms for manoeuvring the heddle frames.

It is another purpose of the invention to simplify the construction of the mechanical devices with cables of the above-mentioned type by reducing the number of their constituent elements.

The invention will be more readily understood on reading the following description with reference to the accompanying drawings, in which:

FIG. 1 is a view in elevation showing the general arrangement of a prior art mechanical device with cables according to the conventional construction.

FIG. 2 shows, on a larger scale, one of the pulling levers of the prior art mechanical device according to FIG. 1.

FIG. 3 is a diagram showing the application of the efforts which are exerted on the prior art lever of FIG. 2.

FIG. 4 is a view similar to FIG. 1, showing a mechanical device with cables here being of the type according to the present invention.

FIG. 5 shows, in perspective one of the pulling levers of this mechanical device.

FIG. 6 is the corresponding diagram.

Referring now to the drawings according to the prior art, the reference 1 in FIG. 1 designates one of the heddle frames of the loom in question. To ensure the vertical manoeuvre of this frame 1 inside the conventional structure 2, two connecting rods 3 are usually employed, each of which pivots on the extension 4 (FIG. 2) of a corresponding pulling lever 5 substantially in sector form, pivoted at 6 on said structure 2. Each lever 5 is subjected on the one hand to the action of a return spring 7 which tends to cause the frame 1 to descend, and on the other hand to a manoeuvring cable 8 which is attached to said lever at 9 and which is guided by the curved wall of said latter, which cable is secured to the end of one of the swinging pulling arms 10 of the dobby 11.

To ensure that the pin 12, which ensures the pivoting of each rod 3 on the extension 4 of the lever 5, may move freely, in the course of the vertical displacement of the frame 1, following the arc of circle a without being hindered by the cable 8, it is indispensable that said cable be oriented aligned with and virtually vertically above the lever 5 envisaged, and a guide pulley 13 must therefore be provided on the path of said cable (FIG. 1), said pulley being carried by the structure 2. If the intermediate pulley 14, adapted for guiding one of the two cables 8, is added to these two pulleys 13, the prior art mechanical device must comprise a total of three pulleys.

The functioning of such a conventional mechanism is understood without difficulty. When one of the arms 10 of the dobby 11 swings upwardly, the cables 8 ensure the tipping of the pulling levers 5 which in turn effect, via the rods 3, the lifting of the frame 1, against springs 7. When, on the contrary, this arm 10 swings downwardly, the springs 7 complement the effect of the weight of the frame to absorb the slack of the cables 8 and allow the said frame to descend.

If the diagram of FIG. 3 is studied, it may be observed that the point of application of each cable 8 on the lever 5 which is associated therewith is located between the pivot 6 and the axis of articulation 12 of the rod 3 on said lever. The conclusion is that in such prior art structures the pulling force which the swinging arms 10 must exert for the lifting of the frame 1 is greater than the resistant force exerted by said frame and the springs 7 which are associated therewith.

With a view to remedying this drawback, the present invention consists in bringing the axis of articulation of the rods substantially within the profile of each pulling lever, and in taking advantage of this particular arrangement to dispense with the guide pulleys 13 of the conventional construction.

As shown in FIGS. 4 and 5, each of the pulling levers, here referenced 20, pivotally supports a rod 21 associated with the frame 1 by a pin 22 placed along an arc of circle concentric to the pivot 23 of said lever or sector on the structure 2, this arc of circle coinciding, in the embodiment envisaged, with the bottom of a groove **20*a* hollowed out on the periphery of this lever for guiding the cable 8. This cable is attached at 24 on the sector 20 and said latter is returned by a spring 25 acting on a stirrup member 26 of which the arms embrace said lever to pivot thereon at 27**.

This arrangement presents two advantages. In the first place, in view of its position, the pin 22 of each lever 20, although defining with the pivot 23 a straight line oriented horizontally of the frame 1, will not interfere with the cable 8 during the manoeuvre of this frame 1, so that this lever may be provided at the level of the upper beam of the structure 2, the four rods 21 (replacing the two rods 3 of the conventional construction of FIGS. 1 and 2) naturally being spaced sufficiently at this end. The two prior art guide pulleys 13 of FIG. 1 are dispensed with in this way, the two pulling levers 20 incorporating to some extent the function of said pulleys; this elimination of the pulleys 13 is obviously favourably shown in the cost price of the mechanism, but, in addition, it enables the functioning thereof to be improved due to the reduction of the masses in movement, the reduction in the number of mechanical members placed in a particularly crowded zone of the loom, and the noteworthy shortening of the length of the cables 8. It will be noted in particular that the efforts exerted on the pivot 23 of each lever 20 are reduced since the transmission chain is more direct.

Moreover, and in particular, an analysis of the diagram of FIG. 6 shows that the pulling force exerted by each cable 8 on the corresponding lever 20 when the frame 1 is lifted is here equal to the resistant effort which is exerted on said lever through the rods 21, since the points of force by application of the cable 8 and by said rods coincide radially on this lever. The effort required to be furnished by the arms 10 of the dobby 11 is thus reduced to a noteworthy extent.

It goes without saying that the springs 25 can be adapted to be associated with the pulling levers or sectors 20 in any other suitable manner, the stirrup member 26 having been shown only to illustrate a possible embodiment.

It will further be understood that the pin 22 for the pivoting of the rods 21 is not necessarily disposed along the arc of the circle defined by the groove 20*a;* in fact, the radial distance between the pivot 23 and this pin 22 may, to a certain extent, be fixed independently of the arc of circle of the groove 20*a* as the cable intersects to some extent the pair of rods 21.

What is claimed is:

1. A mechanical device interposed between each pulling arm of a dobby or other shedding mechanism supported by the structure of a weaving loom and the corresponding heddle frame of the loom, comprising:

a pair of sector levers supported by pivots on said loom structure and spaced apart along the corresponding heddle frame, the sector levers having pivot pins spaced from their pivots to the loom structure;

spaced connecting rods pivotally attached to the corresponding heddle frame and extending toward and coupled to the adjacent sector levers at said pivot pins;

each sector lever having a curved contour profile, and the respective pivot pins being located substantially inside the contour; and a pair of cables extending from the pulling arm respectively to the sector levers, each cable passing around the curved contour profile of the lever and being fixed to the lever at a point remote from the corresponding pivot pin, one cable extending obliquely and directly from the arm to one sector lever, and the other cable extending obliquely from the arm to the other sector lever guided by a single central pulley carried by the loom structure.

* * * * *